United States Patent [19]

Savio et al.

[11] Patent Number: 4,934,128

[45] Date of Patent: Jun. 19, 1990

[54] DEVICE TO FRAME PHOTOGRAPHIC FILMS

[75] Inventors: Luciano Savio, Pordenone, Italy; Edoardo Facchini, Via Molini 61/3, Cordenons (PN), Italy, 33084

[73] Assignee: Edoardo Facchini, Cordenons, Italy

[21] Appl. No.: 312,915

[22] Filed: Feb. 21, 1989

[30] Foreign Application Priority Data

Feb. 25, 1988 [IT] Italy ..... 83326 A/88

[51] Int. Cl.[5] ..... B65B 63/00; B65B 61/06

[52] U.S. Cl. ..... 53/520; 53/564; 53/266 A

[58] Field of Search ..... 53/411, 131, 435, 520, 53/457, 266 A, 457, 564, 255; 29/417, 564.6; 83/364, 365, 371, 443

[56] References Cited

U.S. PATENT DOCUMENTS

| | | | |
|---|---|---|---|
| 3,521,423 | 7/1970 | Koeppe et al. | 53/435 |
| 3,524,299 | 8/1970 | Mundt et al. | 53/457 X |
| 4,004,340 | 1/1977 | Urban | 53/435 X |
| 4,102,029 | 7/1978 | Thompson | 53/520 X |
| 4,123,891 | 11/1978 | Kiejzik | 53/435 |
| 4,237,678 | 12/1980 | Thompson | 53/520 |
| 4,258,531 | 3/1981 | Kiejzik | 53/520 |
| 4,543,771 | 10/1985 | Jensen et al. | 53/520 |
| 4,616,473 | 10/1986 | Hodges et al. | 53/520 |
| 4,787,766 | 11/1988 | Lörsch | 53/520 X |

FOREIGN PATENT DOCUMENTS

| | | | |
|---|---|---|---|
| 1921338 | 4/1969 | Fed. Rep. of Germany | 53/457 |
| 3236842 | 4/1984 | Fed. Rep. of Germany . | |
| 2534038 | 4/1984 | France | 53/520 |

*Primary Examiner*—Horace M. Culver
*Attorney, Agent, or Firm*—Wegner & Bretschneider

[57] ABSTRACT

Device (15) to frame photographic films (18) which is suitable to divide the photographic films (18) into single photographs (19) and to insert and position the photographs (19) between two half-frames (12) forming frames (12) to hold photographs (19) and is fitted to framing machines (10), which comprise storage containers (11) to feed empty frames (12), conveyors (13–14) to convey empty frames (12) and storage bins (21) to receive the finished slide consisting of a frame (12) holding a photograph (18), the empty frames (12) arriving at the device (15) in a direction at a right angle to the direction of feed of the photographic films (18) in the device (15), which comprises in reciprocal cooperation:

- at least two drawing units (22) to draw the photographic film (18), each unit consisting of a powered roller (23) equipped with drawing needles (24) and an opposed roller (25) provided with a groove (26), the opposed roller (25) being movable vertically in relation to the powered roller (23),
- a first knife (30) with a shearing blade (31), and
- an opposed knife (32) with a shearing edge (34) and an opener profile (33) to open the half-frames (112–212) of the frames (12), the first knife (30) and opposed knife (32) being movable reciprocally to cooperate with the frame (12) in forming an opening in the frame (12) for introduction of the photographic film (18), the first knife (30) and opposed knife (32) cooperating with each other to divide the photographic film (18) into single photographs (19) within the opening of the frame (12) thus opened.

6 Claims, 3 Drawing Sheets

DEVICE TO FRAME PHOTOGRAPHIC FILMS

This invention concerns a device to frame photographic films. To be more exact, the invention concerns a device suitable to insert photographic films in mechanically openable frames and to split the photographic films into single photographs inserted in the frames, the splitting being carried out within the frames themselves.

The device according to the invention is fitted to framing machines which are advantageously of a type in which the direction of feed of the photographic film is at a right angle to the direction of feed of the frames.

The state of the art includes framing machines which insert photographs cut from a photographic film into their respective frames.

The frames are opened mechanically while the film is split into single photographs outside the frames. The severed photograph is inserted only partially into the frame; complete insertion is generally performed with mechanical grippers which work in the internal window of the frame.

This method of working leads to scratches, grazes, the depositing of foreign bodies and general damage to the processed photograph and, at the same time, limits greatly the speed of framing by the machine.

The above problems have been partly overcome by using a thrust system for insertion of the photograph into the frame, the photograph being fully inserted into the frame by a required feed of the photographic film that follows the photograph.

One drawback of the known framing devices concerns the drawing of the photographic film. This drawing is performed by claws or sprockets which cooperate with lateral perforations in the film.

Where there are joints in the film, the meshing of the claws or sprockets with the perforations is not perfect and entails faulty drawing of the film.

The drawing of the film can be carried out equally well with a metallic roller and rubberised opposed roller operating on the outer strip of the film, but in this case there will be slipping of the film during drawing, especially at high speed and with abrupt starting.

There are also shortcomings due to the system of fixture of the photographs within the frames.

These systems, when they are of a mechanical type or because of the action of special shapings made on the inner surfaces of the frame, are not very efficient in that such shapings are hard to produce with the required tolerances.

Other systems providing for fixture of part of the photograph with an adhesive on the inner surfaces of the frame entail the drawback of dirtying the photograph or causing tension thereon owing to the temperature gradient while ths slide is being projected.

The present applicant has designed, tested and embodied a framing device able to overcome all the problems of the state of the art.

The device comprises two units to draw the photographic film, each unit consisting of a powered roller with needles coupled to at least one opposed idler roller.

Each of these drawing units acts on a lateral edge of the photographic film and performs the drawing action by means of the needles which perforate the lateral edges.

The perforations in the edges of the film have the further purpose of making on these edges some raised portions which are suitable to achieve fixture of the photograph, when sheared, to the inside of its respective suppport frame.

In this way the photograph is prevented from moving inside the frame during use of the completed slide without the use of adhesives or special inner conformations of the frame.

The drawing of the film by a roller comprising needles according to the invention makes it possible to exclude also any joints on the film and always enables the films to be properly positioned in the station where the photographs are sheared.

Each opposed roller is solidly secured to a body able to move vertically in relation to the plane of the film; this movable body forms a guide for the film during insertion of the film into the frame.

A first knife is solidly fixed to the movable body and cooperates with a stationary opposed knife in performing the operations of a first opening of the two half-frames, a second opening of the same for insertion of the film, insertion of the film into the half-frames thus opened, shearing a photograph inside the half-frames and resetting the first opening of the two half-frames.

Embodiments can be provided equally well in which the opposed knife can move while the first knife is stationary.

When the photograph has been inserted and sheared within its respective frame, the frame is fed towards a discharge station while the framing rotation of the rollers according to the invention brings a new empty frame for the next insertion of a photograph.

The invention is therefore embodied according to the contents of claim 1 and the dependent claims.

The attached figures give a non-restrictive example as follows:

FIGS. 1 and 2 show respectively a front view and a plan view of a framing machines that employs a framing device according to the invention;

FIG. 3 gives a view from above of a framing device according to the invention;

Figure 1:
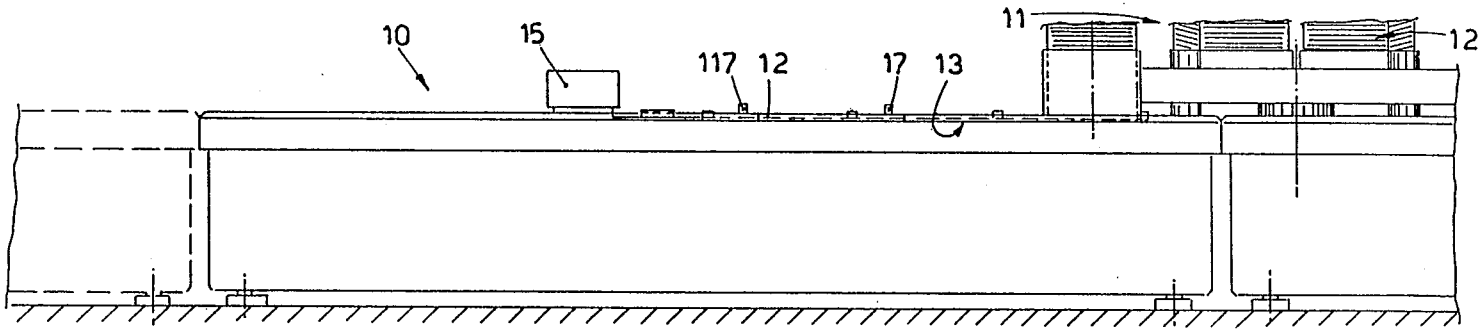
Figure 2:
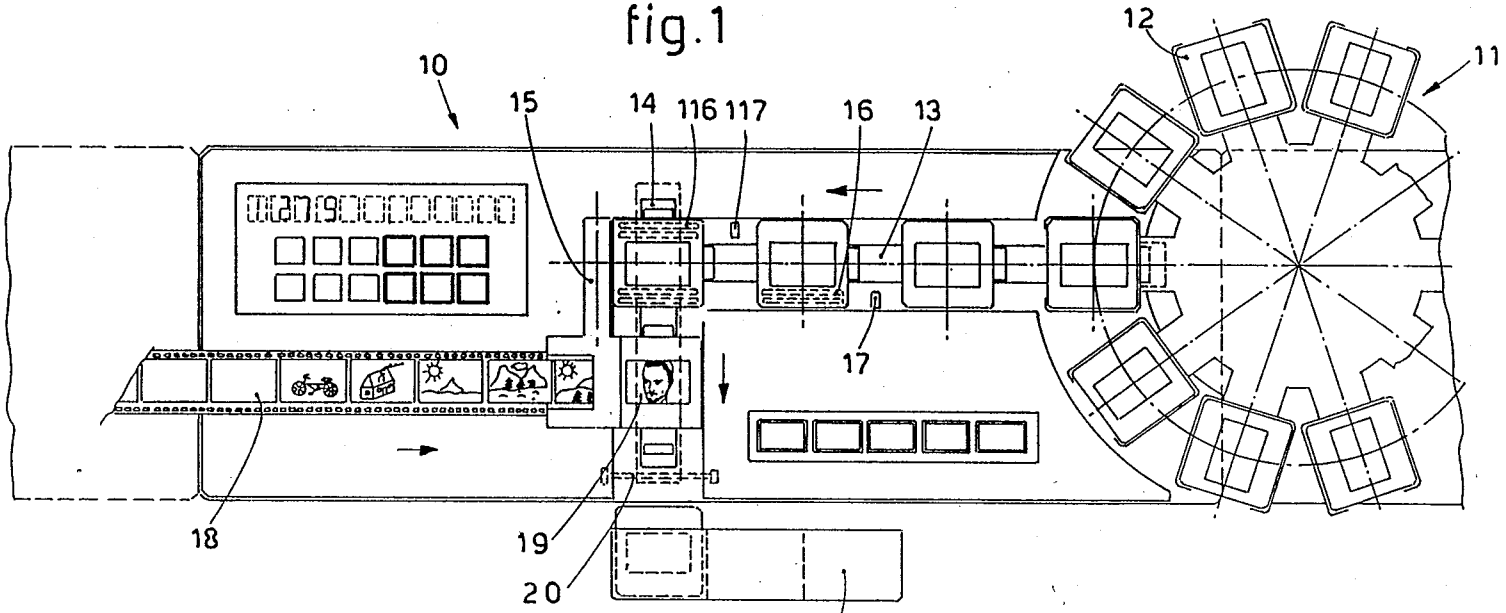

FIGS. 1 and 2 show a framing machine 10 which comprises a storage container 11 for empty frames 12 that feeds a first conveyor 13 conveying the frame 12.

The first conveyor 13 cooperates with a second conveyor 14 in conveying the frames 12 to a framing device 15 according to the invention.

The frames 12 can arrive at the framing device 15 with written messages 16–116 already imprinted on them by imprinting units 17–117.

The framing device 15 is fed with a photographic film 18 which is divided into single photographs 19 to be inserted into the respective frames 12.

The frame 12 with a photograph 19 inserted is fed advantageously to an auxiliary unit 20 for closure of the two halves of the frame 12 and is then discharged into suitable storage bins 21.

Figure 4:
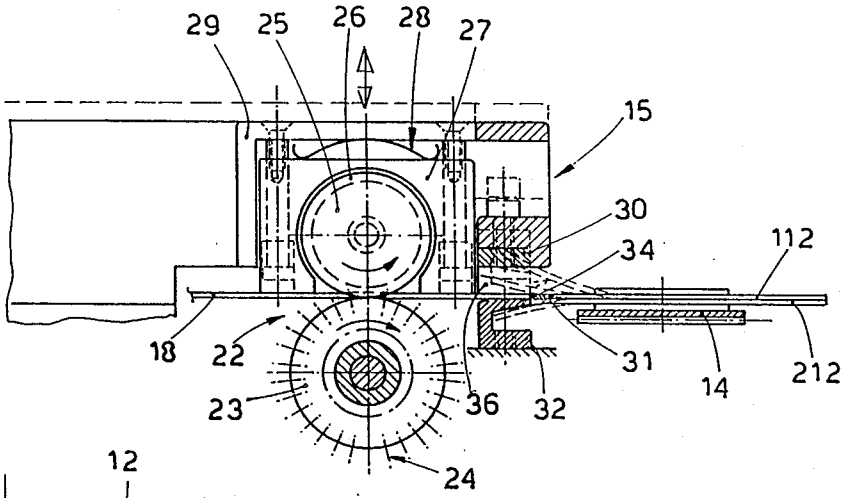
FIG. 4 shows an axial cross section, according to the arrow B of the device of FIG. 3.
Figure 3:
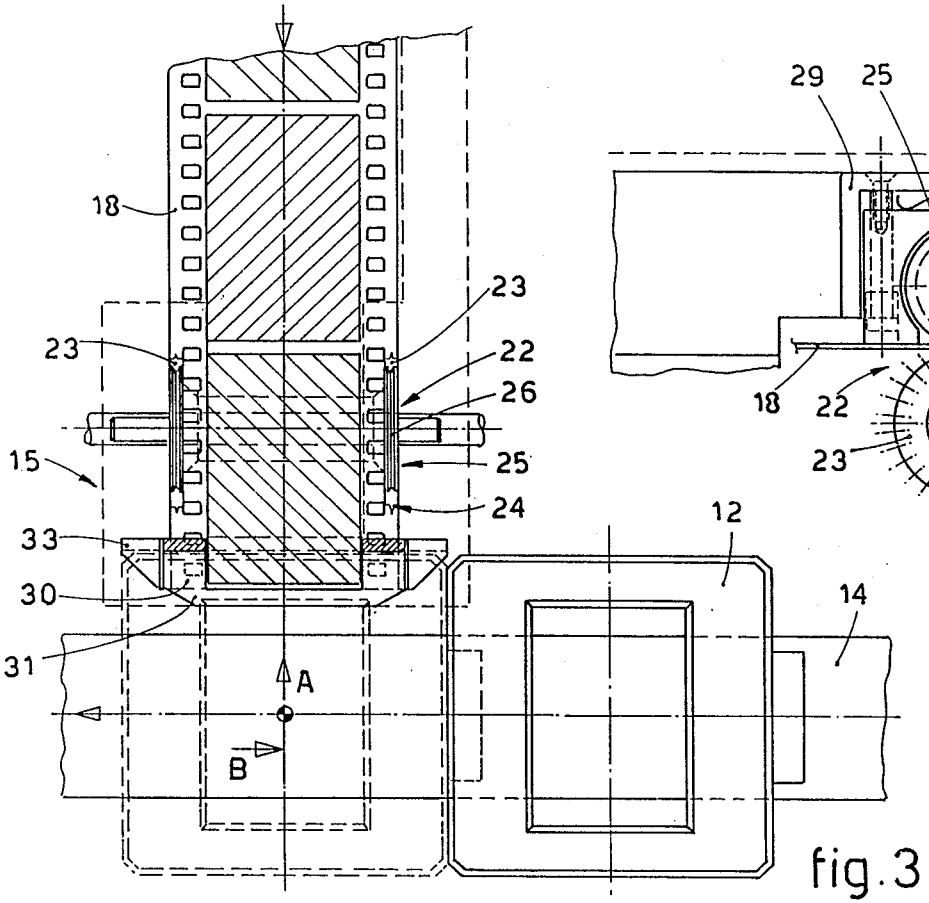
Figure 5:
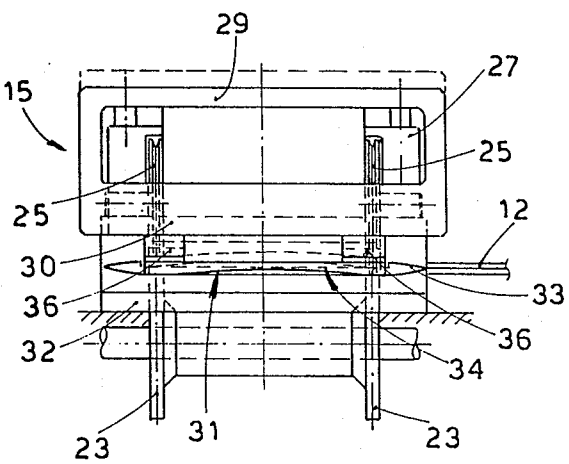
FIG. 5 is a view according to the direction of the arrow A, of the device of FIG. 3.

In FIGS. 3, 4 and 5 the framing device 15 comprises a unit 22 to draw the film 18 on each edge of the film 18.

Each drawing unit 22 consists of a powered roller 23 including drawing needles 24 and an opposed idler roller 25 having a groove 26 for cooperation with the needles 24.

The powered roller 23 is solidly fixed to the body of the machine 10 and obtains its motion in a suitable manner, whereas the opposed idler roller 25 is solidly fixed to a movable body 27 able to move vertically in relation to the film 18 owing to the action of suitable control means (not shown in the figures) of the framing machines 10.

The movable body 27 has the task of guiding the film 18 within appropriate guides by means of a spring 28 retained by a movable element 29.

FIGS. 4 and 5 show with lines of dashes the position taken up by the movable element 29 in its vertical alternating travel.

A first knife 30 is integrally fixed to the movable element 29 and comprises lateral fins 36 bearing a shearing blade 31 having a width slightly greater than the width of the film 18.

The first knife 30 cooperates with a stationary opposed knife 32 which comprises an opener profile 33 having a width coordinated with the width of the frame 12.

The opener profile 33 causes the opening of the two half-frames 112–212 of each frame 12 while the latter 12 is fed on the second conveyor 14 in correspondence with the framing device 15.

In its inactive position the shearing blade 31 of the first knife 30 is in contact with a shearing edge 34 of the opposed knife 32, both knives being inserted in the opening caused in the frame 12 by the opener profile 33.

During the vertical lifting of the movable element 29 the first knife 30 causes a further opening of the upper half-frame 112 and thus provides the conditions for insertion of the film 18 by means of the drawing units 22.

The lowering of the first knife 30 brings the shearing blade 31 into cooperation with the shearing edge 34 of the opposed knife 32, thus causing the photograph 19 to be sheared within the two half-frames 112–212.

Figure 7:
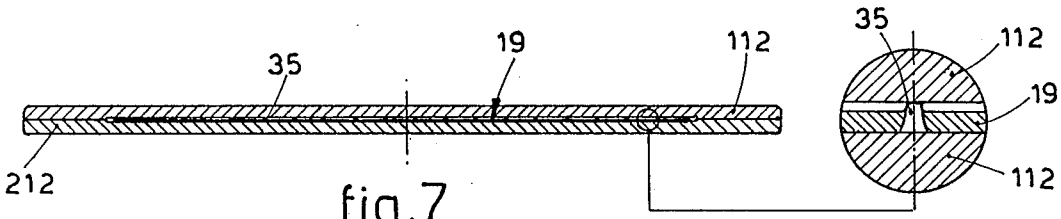
FIG. 7 shows a section of the frame of FIG. 6 according to the line A—A.
Figure 6:
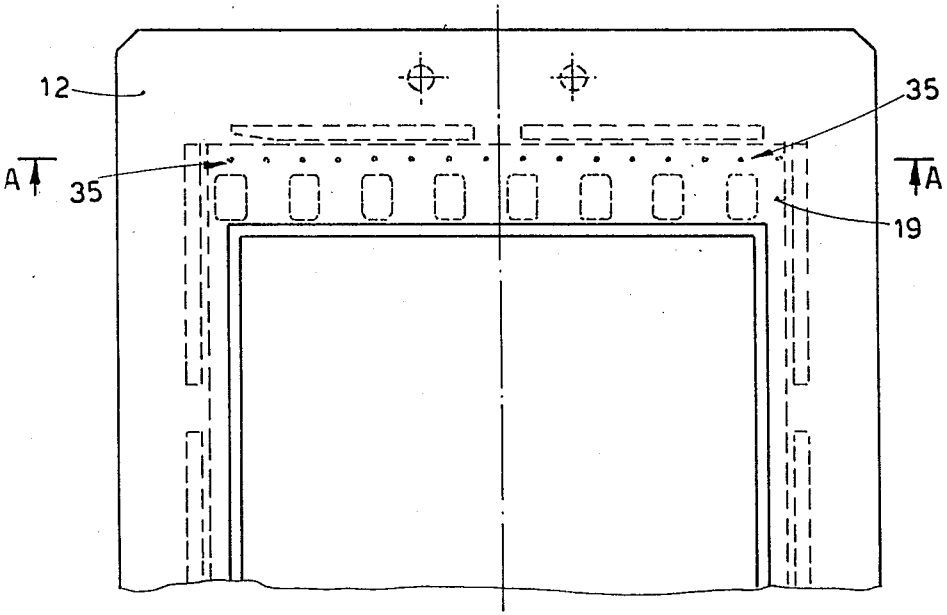
FIG. 6 is a plan view of a frame with a photograph inserted.

FIGS. 6 and 7 show the positioning and fixture of the photograph 19 within the frame 12. The perforations made in the film 18 by the drawing needles 24 of the powered roller 23 provide protrusions suitable to secure the photograph 19 mechanically within the two half-frames 112–212 when the latter have been closed to form the frame 12.

This mechanical fixture prevents the photograph 19 moving or being displaced from its required position in the frame 12 during subsequent use.

We claim:

1. An apparatus for framing photographic film comprising framing means for dividing the photographic film into single photographs and for inserting and positioning the photographs between two half-frames of an empty frame, means for feeding the photographic film to said framing means, and means for conveying empty frame to said framing means, said framing means comprising:

two drawing units for drawing the photographic film, each unit comprising a powered roller having drawing needles extending radially from the perimeter of the powered roller, and an opposed roller having a groove in the perimeter of the opposed roller, said powered roller and said opposed roller positioned such that the drawing needles cooperate with the groove;

a first knife having a shearing blade; and an opposed knife having a shearing edge and further having an opener profile for opening the half-frames of an empty frame, the first knife and the opposed knife positioned such that when the first knife and the opposed knife are moved away from each other, the half-frames are opened for introduction of the photographic film between the half-frames, and such that when the shearing blade and shearing edge are brought into contact, the photographic film is divided into single photographs within the opened half-frames.

2. The apparatus of claim 1, wherein the powered rollers are positioned such that the drawing needles of each powered roller perforate each outer edge of the photographic film.

3. The apparatus of claim 1, wherein each of the opposed rollers and the first knife are solidly fixed to a movable body, said movable body being movable perpendicularly from a plane containing the photographic film.

4. The apparatus of claim 3, wherein the movable body forms a guide for the photographic film during insertion of the film between the half-frames.

5. The apparatus of claim 1, wherein the shearing blade and the shearing edge lie within an opening between the half-frames after opened by the opener profile.

6. The apparatus of claim 1, wherein a direction of feeding the photographic film to said framing means is perpendicular to a direction of conveying the empty frames to said framing means.

* * * * *